United States Patent [19]

Alvarez et al.

[11] 4,022,672

[45] May 10, 1977

[54] ELECTROCHEMICAL SYNTHESIS OF INSECTICIDE INTERMEDIATES

[75] Inventors: Manuel Alvarez, East Brunswick; Morris L. Fishman, East Windsor, both of N.J.

[73] Assignee: FMC Corporation, Philadelphia, Pa.

[22] Filed: Apr. 2, 1976

[21] Appl. No.: 673,038

[52] U.S. Cl. ..... 204/59 R; 260/652 R
[51] Int. Cl.[2] ..... C25B 3/04; C07C 21/00
[58] Field of Search ..... 204/59 R, 7 Z

[56] References Cited

UNITED STATES PATENTS

| | | | |
|---|---|---|---|
| 3,391,068 | 7/1968 | Rauhut | 204/59 R |
| 3,677,916 | 7/1972 | Seiber et al. | 204/59 R |

OTHER PUBLICATIONS

Farkas et al, Collection Czech. Chem. Commun., vol. 24, pp. 2230–2236 (1959).
Organic Electrochemistry by Balzer, pp. 279–314, Pub. by Marcal Dekker, Inc., New York, 1973.
Electrochemistry of Organic Compounds by Tomilov et al., pp. 281–292, pub. by Halsted Press, New York, 1972.

*Primary Examiner*—F.C. Edmundson
*Attorney, Agent, or Firm*—Richard L. Hansen; Henry R. Ertelt

[57] ABSTRACT

1,1,1-Trihalo-4-methylpentenes, carrying 2-substituents selected from those conjugate bases of Bronsted acids which are leaving groups in beta eliminations, are reduced electrochemically to 1,1-dihalo-4-methylpentadienes, intermediates in the synthesis of pyrethroid insecticides.

12 Claims, No Drawings

ELECTROCHEMICAL SYNTHESIS OF INSECTICIDE INTERMEDIATES

BACKGROUND OF THE INVENTION

1. Filed of the Invention

This invention relates to new and improved chemical processed for preparing 1,1-dihalo-4-methylpentadienes, intermediates in a known method for the production of certain pyrethroid insecticides.

2. Description of the Prior Art

Pyrethroids, naturally-occurring and synthetic derivatives of cyclopropanecarboxylic aicd, have long been of interest as insecticides because they are active against a wide range of insect species, they display relatively low toxicity toward mammals, and they do not leave harmful residues. A notable recent technical advance in the pyrethroid art was the discovery of dihalovinylcyclopropanecarboxylates, such as 3-phenoxybenzyl 2-(β,β-dihalovinyl)-3,3-dimethylcyclopropanecarboxylates, having an outstanding combination of insecticide properties [Elliott et al. Nature, 244, 456 (1973); ibid., 246, 169 (1973); South African 73/3528]. Since Elliott's discovery, a great deal of interest has been generated worldwide in economical processes for the production of this type of pyrethroid.

Several years before Elliott's discovery, a method for the production of ethyl 2-(β,β-dichlorovinyl)-3,3-dimethylcyclopropanecarboxylate was reported [Farkas et al., Coll. Czech. Chem. Comm., 24, 2230 (1959)]. The latter leads to an Elliott pyrethroid by ester interchange [Nature, 244, 456 (1973)]. According to the Farkas method, ethyl 2-(β,β-dichlorovinyl)-3,3-dimethylcyclopropanecarboxylate may be prepared from chloral and isobutylene as follows:

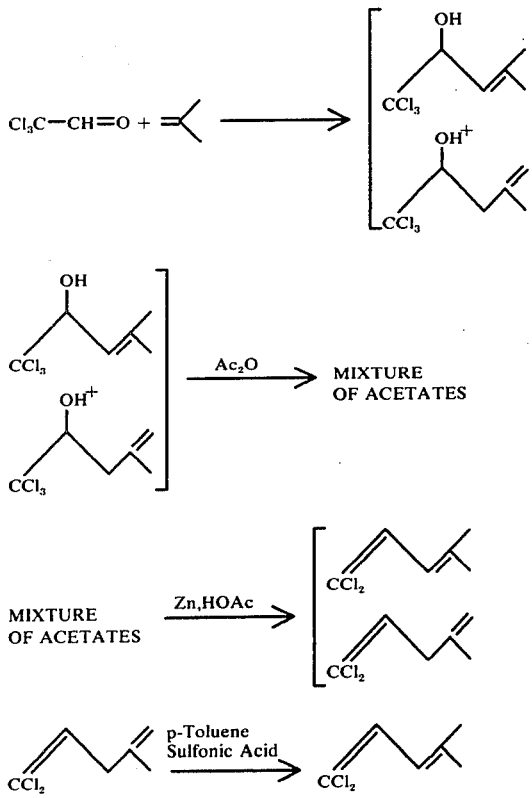

-continued

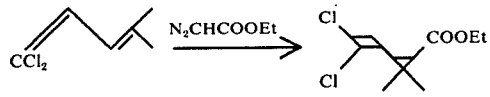

The overall conversion or readily available isobutylene to 1,1-dichloro-4-methyl-1,3-pentadiene, the key intermediate for the diazotization step, is reportedly less than 40%. Furthermore, for every kilogram of 1,1-dichloro-4-methyl-1, 3-pentadiene produced, more than a kilogram of zinc dust is consumed. In a recent year, U.S. producers alone sold about 300 million kilograms of synthetic organic insecticides [Chemical and Engineering News, July 28, 1975, p. 19]. If the Elliott pyrethroid becomes a major agricultural commodity, commercial production of 1,1-dichloro-4-methyl-1,3-pentadiene by the Farkas method would seriously tax the world supply of zinc. A process leading from the mixture of alcohols produced in the first step to the pentadienes produced in the third step of the Farkas route, without consuming zinc, would be advantageous.

It has been known since at least the turn of the century that a chlorine atom bonded to carbon can be displaced in an electrochemical process. For example, symmetrical dichloroethylene can be prepared in 80% yield by the reduction of symmetrical tetrachloroethane at a copper cathode in an aqueous catholyte containing 10% zinc chloride [Brockman, "Electroorganic Chemistry," John Wiley & Sons, Inc., New York, N.Y., 1926, p. 334]. In that reaction, not only are chlorine atoms displaced, but a double bond is introduced. A more recent reference suggests that that reaction really involves the chemical reduction of symmetrical tetrachloroethane by a layer of zinc sponge which is formed on the cathode surface; the electrochemical process is simply the regeneration of the metallic zinc [Tomilov, et al., "Electrochemistry of Organic Compounds," Halsted Press, New York, N. Y., 1972, p. 282].

It is stated in the prior art that cathodic dehalogenation is conducted in protonating media, generally in acid solution, usually in aqueous sulfuric acid or hydrochloric acid [Tomilov, et al., loc cit, p. 284]. Because of the insolubility of many organic halides in water, their reduction may be carried out in a mixture of water and an organic solvent [M. R. Rifi in Baizer, "Organic Electrochemistry," Marcel Dekker, Inc., New York, N. Y., 1973, p. 301].

The electrochemical reduction of a 1,1,1-trihalo compound carrying a 2-hydroxy group has been reported [Tomilov, et al. loc cit, p. 290]. 2-(1,1,1-Trichloro-2-hydroxypropyl)pyridine was reduced to the corresponding 1,1-dichloro-2-hydroxy compound. Nowhere is it suggested in the prior art that a reductive elimination, both the displacement of a halogen atom and the introduction of a double bond, may occur in a single electrochemical process unless the compound contains vicinal halogen atoms.

SUMMARY OF THE INVENTION

It has now been discovered that 1,1,1-trihalo-4-methylpentenes, especially 3- and 4-pentenes, carrying 2-substituents selected from those conjugate bases of Bronsted acids which are leaving groups in beta eliminations, are reduced electrochemically to 1,1-dihalo-4-methylpentadienes, especially 1,3- and 1,4-pentadienes. In reductive eliminations from such 2-substituted 1,1,1-trihalo-4-methylpentenes, one halogen atom and the 2-substituent are eliminated with the introduction of a second double bond.

DETAILED DESCRIPTION OF THE INVENTION

The process of this invention is preferably carried out in an electrochemical cell containing separate anode and cathode compartments, as a continuous flow or batch operation. A cell of the Meites type may also be employed. [Anal. Chem., 27, 1116 (1955)]. The latter comprises three compartments separated by porous media, one compartment containing the anode, another the cathode, and the third compartment, connecting the anode and cathode compartments, filled with enough electrolyte to maintain a positive hydrostatic pressure, minimizing diffusion from the anode and cathode compartments. The electrolysis employs standard electrical components and circuits well known to those skilled in the art, including a potentiostat for controlling the cathode potential with respect to an electrically proximate reference electrode. The type of reference electrode is not critical; a saturated calomel electrode is satisfactory. A saturated calomel reference electrode, which contains water, and other aqueous reference electrodes, preferably should not be placed directly in the catholyte, but should be connected electrically thereto by means of a salt bridge. The type of anode material is not critical. It is only necessary that it be a reasonably good electrical conductor. The anode is preferably not oxidized or dissolved under the conditions of the electrolysis; carbon and platinum are satisfactory. In addition to being reasonably conductive, and preferably not reduced or dissolved under the conditions of the electrolysis, the cathode should not react with the intermediates or products of the reduction; for example, the cathode may be mercury, platinum, palladium, rhodium, iridium, nickel, gold, tungsten, niobium, titanium, cadmium, manganese, thallium, lead, and tin.

In order to achieve the optimum production of a 1,1-dihalo-4-methylpentadiene, an aprotic solvent should be employed, at least in the catholyte. The solvent should not itself be reduced at the potential applied; it should also dissolve both the reducible trihalopentene and a supporting electrolyte, and it should not react with the trihalopentene, reaction intermediates, or the final product. Such solvents include amides, such as formamide and dimethylformamide; as well as acetonitrile, dimethylsulfoxide, sulfolane, pyridine, tetrahydrofuran, and propylene carbonate, for example. Where the 2-substituted 1,1,1-trihalo-4-methylpentene is a 1,1,1-trihalo-2-hydroxy-4-methylpentene, it is desirable to employ a solvent with good hydrogen bonding ability; for exaple, dimethylformamide. The use of such a solvent will reduce the possibility that the trihalopentene will behave as a proton source.

It is also preferable that the solvent be substantially anhydrous. When water, alcohol, or other proton donors are present, the reduction typically results only in the displacement of one or more of the halogen atoms by hydrogen.

A supporting electrolyte should be added to the solvent to increase the conductance of the solution so that the reductive elimination can be carried out at a reasonable rate. In choosing supporting electrolytes, it is important to select a material for the catholyte which is not itself reduced at the potential applied, and a material for the anolyte which is not oxidized. A number of different compounds may be employed, but quaternary ammonium salts are quite soluble in the organic solvents usually employed, are readily available, and so are generally preferred. Such salts include, for example, tetraalkylammonium salts such as tetramethylammonium fluoroborate, tetrabutylammonium fluoroborate; as well as tetraalkylammonium halides and perchlorates. The concentration of the supporting electrolyte in the solvent is not critical, but at a concentration below about 0.1 M the internal resistance of the cell may be too high, depending upon the details of its construction. Generally, the supporting electrolyte concentration will lie in the range 0.1 – 5 M.

The type of halogen substituents desired in the 1,1-dihalo-4-methyl-pentadiene will dictate the halogen substituents in the 2-substituted 1,1,1-trihalo-4-methylpentene. Generally, it is desired to produce a 1,1-dihalo-4-methyl pentadiene in which the halogen substituents are chlorine or bromine. In producing a 1,1-dichloro-4-methyl pentadiene, a 2-substituted 1,1,1-trichloro or 1-bromo-1, 1-dichloro-4-methylpentene is used. A 1,1-dibromo-4-methylpentadiene results from a 2-substituted 1,1,1-tribromo-4-methylpentene; whereas a 1-bromo-1-chloro-4-methyl pentadiene results from the electrolysis of a 2-substituted 1,1-dibromo-1-chloro-4-methylpentene.

As has been indicated, the 1,1,1-trihalo-4-methyl pentenes, electrolyzed according to the process of this invention, will carry 2-substituents selected from those conjugate bases of Brönsted acids which are leaving groups in beta eliminations. Such groups are known to those skilled in the art and include for example, methanesulfonate; trifluoromethane sulfonate; p-toluenesulfonate; chlorosulfinate; halogen; nitrile; alkanoyloxy, such as acetoxy; aroyloxy, such as benzoyloxy; alkoxy, aryloxy, hydroxy, ammonia, and trialkylamine; and thio analogs of these such as methanethiosulfonate p-toluene thiosulfonate; alkanoylthio, such as acetylthio, aroylthio, such as benzoylthio, alkylthio, and mercapto.

The concentration of the 1,1,1-trihalo-4-methylpentene in the catholyte is not critical, but will generally lie in the range 0.001–2 M. For efficiency, a high concentration of the reactant is desirable, but side reactions, such as dimerization, proton abstraction, and so forth, may occur at higher reactant concentrations. The optimum reactant concentration will depend to a considerable extent upon the design of the cathode compartment and upon the efficiency at which the solution is stirred, mixed, or calculated. In general, it is important that good mass transfer at the electrode surface be maintained throughout the course of the reaction.

Depending upon the specific structure of the compound being reduced, the reduction should be carried out at potentials ranging from about −1.0 to −2.0 volts with respect to a saturated calomel reference electrode. Where a 2-hydroxy compound is reduced, the best results are obtained at a potential close to −2.0 volts, whereas the esters may be reduced effectively at somewhat less negative potentials. For example, a chlorosulfinate derivative may be reduced at a potential of −1.0 volts vs a saturated calomel electrode. However, for all of the compounds, potentials in the range −1.5 to −2.0 volts with respect to a saturated calomel electrode are preferred. At potentials more negative than about −2.0 volts, reduction of the solvent and/or the supporting electrolyte may occur. The temperature at which the reaction is conducted is not critical, the upper and lower limits being determined by the bp and fp of the solvent; the reductive elimination proceeds very well at room temperature. Under the conditions which have been described above, the reaction is usually complete in from two to about five hours.

The process of this invention will become clear by reference to the following Examples which illustrate it.

In the Examples which follow, unless stated otherwise, temperatures are in degrees centigrade, and pressures are in millimeters of mercury. Tetramethylsilane was employed as an internal standard for the nmr spectra. In reporting the nmr data, the abbreviations have the following significance: *s*, singlet; *d*, doublet; *t*, triplet; *q*, quartet; *m*, multiplet. Any of these abbreviations may be preceded by b for broad or d for double, for example, dd, double doublet; bt, broad triplet. Vapor phase chromatographic analyses were performed by employing a 1.2 meter × 3.1 mm column packed with SE-30 silicone rubber. The injection port temperature was 275°. The helium flow rate was 30 ml/min. The initial column temperature of 60° was maintained for 1 min after sample injection. The instrument was programmed to then increase the column temperature at the rate of 10°/min to 150°. The temperature of the thermal conductivity detector was 275°.

EXAMPLE I

Electrochemical Synthesis of 1,1-Dichloro-4-methyl-1,4-pentadiene

A. From 1,1,1-Trichloro-2-hydroxy-4-methyl-4-pentene

A three compartment, Meites type, electrochemical cell was used. The anolyte was 1.0 N sulfuric acid; the catholyte and the electrolyte in the central compartment were 0.5 M tetramethylammonium fluoroborate in dimethylformamide. The dimethylformamide had been previously dried over a molecular sieve. The anode was a carbon rod; the cathode was a pool of mercury having a surface area of approximately 23.8 $cm^2$. A saturated calomel electrode (SCE) was connected to the cathode compartment via a double salt bridge (SCE/1 M $Me_4NCl$ in $H_2O$/0.5 M $Me_4NBF_4$ in DMF/catholyte) and served as the reference electrode. Prior to electrolysis, nitrogen was bubbled through the catholyte to remove dissolved oxygen, after which a current/voltage curve was obtained to ascertain that no electrically reducible species were present.

To about 80 ml of the catholyte was added 0.63 g (0.0032 mole) of 1,1,1-trichloro-2-hydroxy-4-methyl-4-pentene. With continuous stirring of the catholyte, a potential of −2.0 v vs SCE was applied to the cathode. A maximum current of 190 ma was noted during the 2-½ hour electrolysis. At the conclusion of the electrolysis, the catholyte was transferred to a separatory funnel, and 50 ml of hexane plus 150 ml of water chilled to 0° were added. The hexane layer was separated. The aqueous layer was again extracted with 50 ml of hexane. The combined hexane extract was thrice washed with 50 ml portions of water, dried over anhydrous sodium sulfate, and filtered.

The volume of the filtrate was reduced by evaporation to approximately 1 ml, and the residue was dried over anhydrous sodium sulfate. Vapor phase chromatographic analysis of the bright yellow residue indicated that it consisted of 35.2% 1,1-dichloro-4-methyl-1,4-pentadiene.

B. From 1,1,1-Trichloro-2-4-methyl-4-pentene

1. Synthesis of 1,1,1-trichloro-2-acetoxy-4-methyl-4-pentene

A mixture of 1321 g of 1,1,1-trichloro-2-hydroxy-4-methyl-4-pentene, 695 g of acetic anhydride, and 32.6 ml of pyridine was heated at 95°–100° for 1 hour. The low boiling by-products were removed under vacuum, and the residue was then distilled, yielding 1276 g of 1,1,1-trichloro-2-acetoxy-4-methyl-4-pentene; bp, 87°/5.5 mm.

2. Reductive elimination from 1,1,1-trichloro-2-acetoxy-4-methyl-4-pentene A three compartment, Meites type, electrochemical cell was employed. The anode was a carbon rod and the anolyte was 1.0 N sulfuric acid. The electrolyte in the cathode compartment and in the connecting chamber contained 0.1 M tetrabutylammonium fluoroborate in acetonitrile. The cathode was a pool of mercury having a surface area of about 23.8 $cm^2$. The catholyte was deoxygenated by bubbling nitrogen through the solution. After obtaining a current/voltage curve to be certain that no substances electrically reducible in the 0 to −2 v range vs SCE were present, 0.62 g of 1,1,1-trichloro-2-acetoxy-4-methyl-4-pentene was added to the catholyte. The catholyte was stirred and a potential of −1.5 v vs SCE was applied to the cathode. Electrolysis was continued for 5¼ hours. During this time the current averaged approximately 100 ma, but decreased to about 21 ma at the end of the period.

The catholyte was removed from the cell and concentrated by evaporation. The concentrate was then diluted with 100 ml of water and extracted twice with 100 ml portions of hexane. After drying the hexane extract with anhydrous sodium sulfate, it was further concentrated to 1 ml of colorless oil. Vapor phase chromatography, coupled with mass spectrometry, indicated that the oil contained 31.8% 1,1-dichloro-4-methyl-1,4-pentadiene as well as 9.1% 1,1-dichloro-4-methyl-1,3-pentadiene, in addition to 35.5% 1,1-dichloro-2-hydroxy-4-methyl-4-pentene.

C. From 1,1,1-Trichloro-4-methyl-4-penten-2-yl methanesulfonate

1. Synthesis of 1,1,1-trichloro-4-methyl-4-penten-2-yl methanesulfonate

To a stirred solution of 20.4 g of 1,1,1-trichloro-2-hydroxy-4-methyl-4-pentene in 200 ml of pyridine, cooled to 0°, was added 12.6 g of methanesulfonyl chloride. The reaction mixture was allowed to warm to room temperature. After stirring overnight at room temperature, the reaction mixture was poured into one liter of cold water. The aqueous mixture was extracted three times with hexane. Subsequently, the combined hexane extract was washed successively with cold hydrochloric acid and water, then dried over anhydrous magnesium sulfate. The hexane solution was concentrated and cooled, yielding two crops of a crystalline solid whose combined weight was 19.4 g. The first crop, mp 60°–61° had the following properties consistent with 1,1,1-trichloro-4-methyl-4-penten-2-yl methanesulfonate.

Analysis: Calculated for $C_7H_{11}Cl_3O_3S$: C 29.84; H 3.91; Cl 37.83; S 11.37; Found: C 29.89; H 4.06; Cl 37.76; S 11.48. nmr δ ppm ($CDCl_3$): 1.8 (s, 3H), 2.5 (m, 2H), 3.2 (s, 3H), 4.1 (m, 1H), 4.9 (s, 2H).

2. Reductive elimination from 1,1,1-trichloro-4-methyl-4-penten-2-yl methanesulfonate a. at a mercury cathode The method of Example B.2. was employed to electrolyze 0.5 g of 1,1,1-trichloro-4-methyl-4-penten-2yl methanesulfonate for 4.5 hr at −1.5 v vs SCE. A maximum current of 200 ma was observed. After first concentrating the catholyte, and then adding 200 ml of water, the catholyte was thrice extracted with 75 ml portions of methylene chloride, adding methanol each time to cause separation of the layers. The combined extracts were washed with 100 ml of water and dried over anhydrous sodium sulfate. The methylene chloride solution was concentrated to 25.0 ml, and a 5.0 ml aliquot was analyzed by vapor phase chromatography after adding an internal standard. The analysis indicated that 1,1-dichloro-4-methyl-1,4-pentadiene was produced in 81% yield.

b. at a platinum cathode

A small two compartment electrochemical cell was constructed from two short pieces of glass tubing, having an inside diameter of 3.8 cm, layed on a common axis and separated by a teflon filter. Electrodes in both compartments were of platinum foil. Each compartment contained ports for transferring solutions into and out of the compartment and for deoxygenation. The cathode compartment was also fittes with a port into which a reference electrode was inserted. A 0.1 M solution of tetrabutylammonium fluoroborate in acetonitrile served as both catholyte and anolyte. After deoxygenating the catholyte (about 10 ml) by bubbling nitrogen through it, 0.125 g. of 1,1,1-trichloro-4-methyl-4-penten-2-yl methanesulfonate was added to the catholyte and electrolysis at a cathode potential of −2.0 v vs Ag/0.01 M $AgNO_3$ in acetonitrile (−1.5 v vs SCE) was conducted for 1 hour. A maximum current of 6 ma was observed. Then an additional 0.900 g of 1,1,1-trichloro-4-methyl-4-penten-2-yl methanesulfonate was added to the catholyte. The cathode potential was increased to −2.25 v vs Ag/0.01 M $AgNO_3$ in acetonitrile (−1.75 v vs SCE) and electrolysis was continued for a period of four hours. The maximum current was 100 ma. At the conclusion of the electrolysis, 75 ml of water was added to the catholyte, and the mixture was thrice extracted with 25 ml portions of hexane. Subsequently, the combined hexane extract was fractionally distilled to remove most of the hexane, reducing the volume to 25 ml. Vapor phase chromatography indicated that the product was 94% 1,1-dichloro-4-methyl-1,4-pentadiene.

D. From 1,1,1-Trichloro-4-methyl-4-penten-2-yl chlorosulfinate

1. Synthesis of 1,1,1-trichloro-4-methyl-4-penten-2-yl chlorosulfinate

To 20.35 g of 1,1,1-trichloro-2-hydroxy-4-methyl-4-pentene was added 23.8 g of thionyl chloride. The resulting solution was heated at 80°–90° for one hour. After cooling, the excess thionyl chloride was removed under reduced pressure. The residue was fractionally distilled. A fraction weighing 5.9 g; bp, 100°/2.8 mm, was analyzed by vapor phase chromatography and mass spectrometry. The major component of the fraction was identified as 1,1,1-trichloro-4-methyl-4-penten-2-yl chlorosulfinate.

2. Reductive elimination from 1,1,1-trichloro-4-methyl-4-penten-2-yl chlorosulfinate The three compartment electrochemical cell was essentially a covered beaker with two sidearms, each of which was separated from the central compartment by a fritted glass disc. One side arm contained the anode and the anolyte. The other side arm was connected to the reference electrode by a salt bridge. An electrically conductive plug was prepared by dissolving 0.542 g of tetraethylammonium fluoroborate in 25 ml of dimethylformamide, and then adding 1 g of 4000 cps grade methyl cellulose. This mixture was heated with stirring, and was then poured into the anode sidewarm to form a gelatinous barrier between the anolyte and the catholyte. A carbon rod was inserted into one sidearm as the anode, while a rotating platinum gauze was used as the cathode. The electrolyte was 0.1 M tetrabutylammoinium fluoroborate in acetonitrile, and the reference was a Ag/0.01 M $AgNO_3$ in acetonitrile electrode inserted in the catholyte. To the catholyte was added 0.532 g of 1,1,1-trichloro-4-methyl-4-penten-2-yl chlorosulfinate, and a potential of −1.5 v vs Ag/0.01 M $AgNO_3$ in acetonitrile (−1.0 v vs SCE) was applied to the cathode for 4 ⅓ hours. The maximum current was 100 ma. At the conclusion of the electrolysis, the catholyte was removed from the cell, diluted with 200 ml of water, and then extracted three times with 75 ml portions of hexane. After being dried over anhydrous sodium sulfate, the combined hexane extracts were concentrated to 25 ml. Vapor phase chromatographic analysis of the concentrate indicated that the product comprises predominately 1,1,1-trichloro-2-hydroxy-4-methyl-4-pentene, but also 10.1% 1,1-dichloro-4-methyl-1,4-pentadiene and 3.3% 1,1-dichloro-4-methyl-1,3-pentadiene.

EXAMPLE II

Electrochemical Synthesis of 1,1-Dichloro-4-methyl-1,3-pentadiene

A. From 1,1,1-Trichloro-2-acetoxy-4-methyl-3-pentene

1. Synthesis of 1,1,1-trichloro-2-acetoxy-4-methyl-3-pentene

A mixture of 53 g of 1,1,1-trichloro-2-hydroxy-4-methyl-3-pentene, 28 g. of acetic anhydride, and 1.23 ml of pyridine was heated at 95°–100° for one hour. The reaction mixture was then dissolved in 500 ml of hexane. This solution was washed thrice with 150 ml portions of water and dried over anhydrous magnesium sulfate. After stripping the hexane, the residue was distilled under reduced pressure, yielding 52 g of 1,1,1-trichloro-2-acetoxy-4-methyl-3-pentene; bp 85°–90°λ /4–4.3 mm. An nmr spectrum of this product was consistent with the assigned structure.

2. Reductive elimination from 1,1,1-trichloro-2-acetoxy-4-methyl-3-pentene

The method of Example I.B.2. was employed to electrolyze 0.62 g (0.0025 mole) of 1,1,1-trichloro-2-acetoxy-4-methyl-3-pentene at −1.5 v vs SCE for 4.66 hour. The maximum current was 165 ma. After concentrating the catholyte to approximately 10 ml, it was diluted with 50 ml of water. The aqueous mixture was thrice extracted with 100 ml of hexane, and the combined hexane extract was dried over anhydrous sodium sulfate. The hexane was evaporated, leaving 10 ml of a colorless liquid. Analysis by vapor phase chromatography indicated a 48% yield of 1,1-dichloro-4-methyl-1,3-pentadiene.

We claim:

1. In a process for producing a pyrethroid insecticide via a 1,1-dihalo-4-methylpentadiene, the improved synthesis of said 1,1-dihalo-4-methylpentadiene which comprises reducing electrochemically a 2-substituted 1,1,1-trihalo-4-methylpentene; wherein the 2-substituent is selected from those conjugate bases of Brönsted acids which are leaving groups in beta eliminations; whereby one halogen atom and the 2-substituent are eliminated with the introduction of a second double bond, yielding said 1,1-dihalo-4-methylpentadiene.

2. The process of claim 1 wherein th electrochemical reduction is carried out in an aprotic, substantially anhydrous solvent.

3. The process of claim 2 wherein the electrochemical reduction is carried out at a cathode potential between −1.5 v and −2.0 v vs SCE.

4. The process of claim 3 wherein the 2-substituent is selected from hydroxy, acetoxy, methanesulfonate, and chlorosulfinate.

5. A process for producing a 1,1-dihalo-4-methyl-1,3-or 1,4-pentandiene or a mixture thereof which comprises reducing electrochemically a 2-substituted 1,1,1-trihalo-4-methyl-3 or 4-pentene or mixture thereof; wherein the 2-substituent is selected from those conjugate bases of Bronsted acids which are leaving groups in beta eliminations; whereby one halogen atom and the 2-substituent are eliminated with the introduction of a second double bond, yielding said 1,1-dihalo-4-methyl-1,3 or 1,4-pentadiene or mixture thereof.

6. The process of claim 5 wherein the electrochemical reduction is carried out in an aprotic, substantially anhydrous solvent.

7. The process of claim 6 wherein the electrochemical reduction is carried out at a cathode potential between −1.5 v and −2.0 v vs SCE.

8. The process of claim 7 wherein the 7-substituent is selected from hydroxy, acetoxy, methanesulfonate, and chlorosulfinate.

9. A process for producing 1,1-dichloro-4-methyl-1,3 or 1,4-pentadiene or a mixture thereof which comprises reducing electrochemically 1,1,1-trichloro-4-methyl-3 or 4-penten-2-yl methanesulfonate or a mixture thereof, whereby one chlorine atom and the methanesulfonate group are eliminated with the introduction of a terminal double bond, yielding said 1,1-dichloro-4-methyl-1,3 or 1,4-pwentadiene or mixture thereof.

10. The process of claim 0 wherein the electrochemical reduction is carried out in an aprotic, substantially anhydrous solvent.

11. The process of claim 10 wherein the electrochemical reduction is carried out at a cathode potential between −1.5 v and −2.0 v vs SCE.

12. The process of claim 11 wherein the solvent is acetonitrile.

* * * * *

UNITED STATES PATENT OFFICE
CERTIFICATE OF CORRECTION

Patent No. 4,022,672 Dated May 10, 1977

Inventor(s) Manuel Alvarez and Morris L. Fishman

It is certified that error appears in the above-identified patent and that said Letters Patent are hereby corrected as shown below:

In OTHER PUBLICATIONS, line 3, "Balzer" should read --Baizer--.
In the ABSTRACT, line 2, "Bronsted" should read --Brönsted--.
Col. 1, line 6, "Filed" should read --Field--;
line 8, "processed" should read --processes--;
line 13, "aicd" should read --acid--.
Col. 2, line 7, "or" should read --of--;
line 66, "Bronsted" should read --Brönsted--.
Col. 4, line 40, "alkylthio, and mercapto" should read --alkylthio, arylthio, and mercapto--.
line 50, "calculated" should read --circulated--.
Col. 6, line 1, "1,1,1-Trichloro-2-4-methyl-4-pentene" should read --1,1,1-Trichloro-2-acetoxy-4-methyl-4-pentene--.
Col. 7, line 31, "fittes" should read --fitted--.
Col. 8, line 16, "sidewarm" should read --sidearm--.
lines 20 & 21, "tetrabutylammoinium" should read --tetrabutylammonium--.
line 57, delete "λ".
Col. 9, line 18, "wherein th" should read --wherein the--.
line 28, "1,4-pentandiene" should read --1,4-pentadiene--.
line 32, "Bronsted" should read --Brönsted--.

UNITED STATES PATENT OFFICE

CERTIFICATE OF CORRECTION

Patent No. 4,022,672 Dated May 10, 1977

Inventor(s) Manuel Alvarez and Morris L. Fishman

It is certified that error appears in the above-identified patent and that said Letters Patent are hereby corrected as shown below:

Col. 10, line 12, "7-substituent" should read --2-substituent--.
line 22, "1,4-pwentadiene" should read --1,4-pentadiene--.
line 24, "claim 0" should read --claim 9--.

Signed and Sealed this

*Thirteenth* Day of *September 1977*

[SEAL]

*Attest:*

RUTH C. MASON
*Attesting Officer*

LUTRELLE F. PARKER
*Acting Commissioner of Patents and Trademarks*